US005583831A

United States Patent [19]

Churchill et al.

[11] Patent Number: 5,583,831

[45] Date of Patent: Dec. 10, 1996

[54] MEMORY ASSISTANCE APPARATUS TO IMPROVE PRESCRIPTION COMPLIANCE

[75] Inventors: Russell J. Churchill; John A. Neal, both of Radford, Va.; Howard P. Groger, Gainesville, Fla.; Chong T. Ng, Radford, Va.

[73] Assignee: American Research, Radford, Va.

[21] Appl. No.: 299,437

[22] Filed: Sep. 1, 1994

[51] Int. Cl.[6] ..... G04B 47/00

[52] U.S. Cl. ..... 368/10

[58] Field of Search ..... 368/10

[56] References Cited

U.S. PATENT DOCUMENTS

| | | | |
|---|---|---|---|
| 4,258,354 | 3/1981 | Carmon et al. | 368/10 |
| 4,382,688 | 5/1983 | Machamer | 368/10 |
| 4,483,626 | 11/1984 | Noble | 368/10 |
| 4,504,153 | 3/1986 | Schollmeyer et al. | 368/16 |
| 4,616,316 | 10/1986 | Hampeter et al. | 368/10 |
| 4,617,557 | 10/1986 | Gordon | 368/10 |
| 4,682,299 | 7/1987 | McIntosh et al. | 368/10 |
| 4,695,954 | 9/1987 | Rose et al. | 368/10 |
| 4,766,542 | 8/1988 | Pilarczyk | 368/10 |
| 4,782,966 | 11/1988 | Thackrey | 368/10 |
| 4,831,562 | 5/1989 | McIntosh et al. | 368/10 |
| 4,899,839 | 2/1990 | Dessertine et al. | 368/10 |
| 4,911,327 | 3/1990 | Shepherd et al. | 368/10 |
| 4,939,705 | 7/1990 | Hamilton et al. | 368/10 |
| 4,942,544 | 7/1970 | McIntosh et al. | 368/10 |
| 4,970,669 | 11/1990 | McIntosh et al. | 368/10 |
| 5,011,032 | 4/1991 | Rollman | 368/10 |
| 5,014,798 | 5/1991 | Glynn | 368/10 |
| 5,016,172 | 5/1991 | Dessertine | 368/10 |
| 5,020,037 | 5/1991 | Raven | 368/10 |
| 5,072,430 | 12/1991 | Eckernas et al. | 368/108 |
| 5,088,056 | 2/1992 | McIntosh et al. | 368/10 |
| 5,099,463 | 3/1992 | Lloyd et al. | 368/10 |
| 5,157,640 | 10/1992 | Backner | 368/10 |
| 5,200,891 | 4/1993 | Kehr et al. | 368/10 |
| 5,441,047 | 8/1995 | David et al. | 128/670 |

*Primary Examiner*—Bernard Roskoski

*Attorney, Agent, or Firm*—James Creighton Wray

[57] ABSTRACT

The present invention is a new electronic memory-assist device which can be used to remind an individual when it is time to take a prescribed medicine. The invention uses complementary metal-oxide semiconductor technology in conjunction with surface-mounted device technology to provide a programmable portable unit. The device has three parts: a body-carried reminder, a local interactive compliance processor and a supervisory unit. The reminder has a portable power supply, microprocessors, software, memory, an alarm, an input key and communication linkage to the compliance processor. The compliance processor has a central processing unit, a pill case, a modem and, possibly, a recharger for the portable power supply. The supervisory unit is connected to the central processing unit remotely by modems. The device operates by providing data to the user through an alarm that it is time to take prescribed medication. The alarm is visual, auditory, tactile or any combination of the three. The alarm is initiated by software controlling microprocessors in the body-carried reminder and the pill case. The alarm is generated by comparison between the current time and times residing in the prescription database. The alarm continues until interrupted by either a request for more time prior to compliance or through reception of a message signifying that medication has been taken. All compliance data is stored in the central processing unit of the compliance processor.

18 Claims, 2 Drawing Sheets

MEMORY ASSISTANCE APPARATUS TO IMPROVE PRESCRIPTION COMPLIANCE

BACKGROUND OF THE INVENTION

A successful medical treatment program relies heavily on patients' compliance with prescription regimens established by doctors. Remembering to take a pill can be a demanding responsibility, especially if the prescribed time is not near a meal or when the patient first gets up in the morning. This forgetfulness becomes even more of a problem when dealing with the elderly. As individuals become older, the number of different medications they take usually increases, resulting in complex prescription regimens. Forgetting to take a pill, or taking medication at the wrong time, can lead to harmful results. Presently, adverse drug responses are responsible for 30,000 deaths per year and 1.5 million hospital admissions per year. With the number of individuals over 55 years of age who are on complex prescription regimens at 30 million and rising, a tremendous need has developed for a memory assistance device which will improve prescription compliance.

A successful reminder device will be 1) portable, so that patients can travel freely and not miss the alert; 2) communicable, with a processing unit for monitoring the response of the patient to the alert so as to ensure that the medication was actually taken; 3) communicable, through the processing unit, with a supervisory unit, positioned in a physician's office, pharmacy and/or health care providers facilities so that noncompliance with the prescription regimen can be detected and addressed immediately; and 4) reprogrammable with great ease from various locations, including the physician's office and the pharmacy.

While efforts have been made to develop reminder systems, none has proven successful because of its inability to incorporate the above features. A long felt need exists for reminder devices that effectively embody all of the attributes listed above.

The present invention describes and claims a reminder apparatus that solves these needs associated with improved prescription compliance.

SUMMARY OF THE INVENTION

The present invention is a new electronic memory-assist device for reminding an individual when it is time to take a prescribed medication. The device has three parts: a body-carried reminder, a local interactive compliance processor, and a remote supervisory unit. The present invention uses complementary metal-oxide semiconductor (CMOS) technology in conjunction with surface-mounted device (SMD) technology to provide a programmable portable alarm unit.

The compliance system includes the programmable wrist-worn or pendant-worn electronic unit a radio-frequency or infrared communications link, a central microprocessor-based receiver/transmitter unit with a telephone modem and battery recharger, a pill case with radio frequency or infrared linkage to the wrist-worn or pendant-worn electronic device, an auditory alarm, a tactile alarm, and a visual display, a database containing the medical history of the user, the prescription regimen and the user response to the reminder.

The compliance system will operate by providing data to the user through the liquid crystal display that it is time to take a prescribed medication. The reminder is augmented with auditory or tactile signalling through the user-worn electronic device. The alarm is initiated by software controlling microprocessors in the wrist or pendant unit and in the pill case. The alarm is generated by comparison between the current time and times residing in the prescription database. The alarm can be interrupted by either a request for more time prior to compliance or through reception of a signal from the pill case that the medication has been taken. Data on user compliance is stored in the central processing unit. Where compliance is not observed, the system provides this data to a prearranged location via telephone modem. The RF or infrared link from the wrist-worn or pendant-worn electronic device to the central processing unit provides a data linkage for physiological variables.

The reminder has an array of microprocessors, a portable power supply, an alarm, software to implement a medication database, and input keys, for putting data into the database. A memory stores data from the database, and a communication means communicates data from the database to the local interactive compliance processor. The reminder can be worn on a wrist, as a watch, or on a pendant. Any type of alarm can be employed, including a liquid crystal display or an alarm, or both. A preferred embodiment includes a visual display augmented concurrently or subsequently with auditory or tactile signaling. Possible means for communicating data between the reminder and the local interactive compliance processor includes radio frequency and infrared communications links. The information communicated includes data on user prescription schedule, user compliance and user physiologic conditions for the user's awareness, and also noncompliance alarms to professional and family caregivers.

A medication compliance device has a central processing unit, a pill case, a means for communicating with the body-carried reminder to provide data on the use of the pill case, and a modem. The compliance processor is located in the user's home or office. Communication between the compliance device and the reminder can be through radio frequency or infrared linkage.

A preferred embodiment of the present invention has a database to store a prescription regimen and a communications link which provides for two-way communication between the compliance processor and the reminder. The compliance device has a telephone modem which is used to alarm professional health care providers and family caregivers in instances of noncompliance with the prescription regimen. The compliance processor may also include a recharging device, such as a battery recharger, for recharging the body-carried reminder.

The remote supervisory unit is a processing unit, attached to a modem. The supervisory unit can be placed in a physician's office, in a pharmacy, or at care-giver's facilities. The unit is used to obtain data and to input data into the body-carried reminder during a patient's visit. It is also capable of receiving and inputting data to and from the compliance processor via its modem.

The present invention operates by providing data to the user through alarms that it is time to take a prescribed medication. The alarm is initiated by software controlling microprocessors in the body-carried unit and in the pill case. The alarm, which can be visual, auditory, tactile, or any combination of the three, is generated by comparison between the current time and the times registered in the prescription database. Once initiated, the alarm continues until the user either complies or requests more time prior to compliance. In the case of compliance, the alarm is interrupted through reception of a signal from the pill case that the medication has been taken. A temporary interruption and delay can be achieved by delivering a delay message directly to the body-carried reminder, by pressing an input key for example.

Data on user compliance or noncompliance is stored in the central processing unit of the local interactive compliance processor. When compliance is not observed, the central processing unit transmits this data by a modem to a prearranged location where a supervisory unit is located. Thus, a physician, pharmacist, or other care-giver, can successfully monitor a user's compliance with a prescription regime and can limit adverse drug responses in patients.

The present invention addresses the limitations encountered in the prior art. This device extends the prior art by alarming the user through interaction between a microprocessor-controlled programmable, portable electronic device and a programmable pill case. Also, software on compliance monitoring and alarm is an improvement over the prior art because it allows complex prescription regimens to be monitored by multiple pharmacies or health care professionals. In addition, the medication database in the reminder can be easily reprogrammed when a user's prescription changes.

The present invention, with its useful improvements, can be used by physicians, pharmacists, care-givers and others who implement or monitor prescription regimes. Pharmacists can use this invention to update medication schedules and monitor compliance when a customer fills a prescription. Physicians can use the memory-assist device to monitor compliance and alter medication schedules as needed between prescription refills. Care-givers can use the present invention as a reminder device for complex prescription regimes.

These and further and other objects and features of the invention are apparent in the disclosure, which includes the above and ongoing written specification, with the claims and the drawings.

DETAILED DESCRIPTION OF THE DRAWINGS

Figure 1:
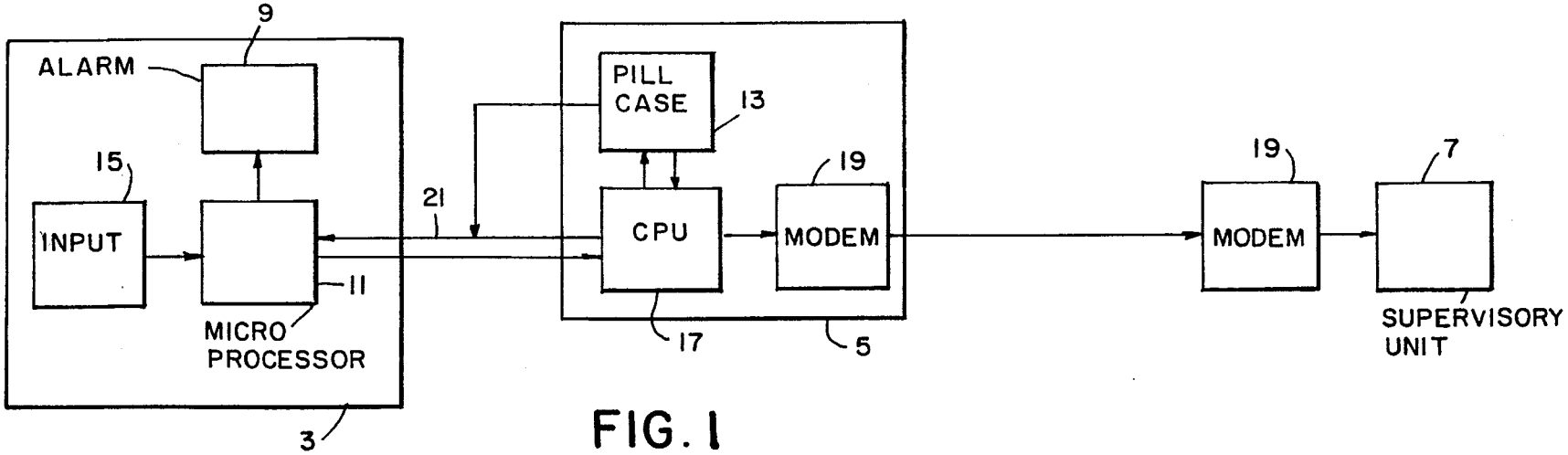
FIG. 1 is a schematic of the memory-assist device showing the interaction between the three parts and their components.

FIG. 1 is a detailed schematic of the memory-assist device 1. The device 1 has three parts, which include a body-carried reminder 3, a local interactive compliance processor 5 and a supervisory unit 7. The present invention operates by providing data to the user through an alarm 9, located in the body-carried reminder 3. The alarm 9 is initiated by microprocessor array 11 in the reminder 3 and the pill case 13. Once introduced, the alarm 9 continues to function until interrupted.

A user may enter a request for more time prior to compliance to interrupt the alarm. That can be accomplished by depressing an input key 15 on the reminder 3, thereby delivering a message to the microprocessor 11 to interrupt the alarm 9. Stopping the alarm 9 requires the user to take the medication. In that situation, the alarm 9 is stopped because a signal from the pill case 13 is delivered to the microprocessor 11 in the body-carried reminder 3 informing the alarm that the medication has been taken. Data on user compliance or noncompliance to the alarm 9 is stored in the central processing unit 17 of the compliance processor 5. In situations in which the user does not comply, the central processing unit 17 delivers a message by modem 19 to a supervisory unit 7. All messages between the body-carried reminder 3 and the local interactive compliance processor 5 can be delivered by a communications linkage 21, such as an infrared link or a radio frequency link. The preferred embodiment of the present invention uses a two-way communications link 21.

Figure 2:
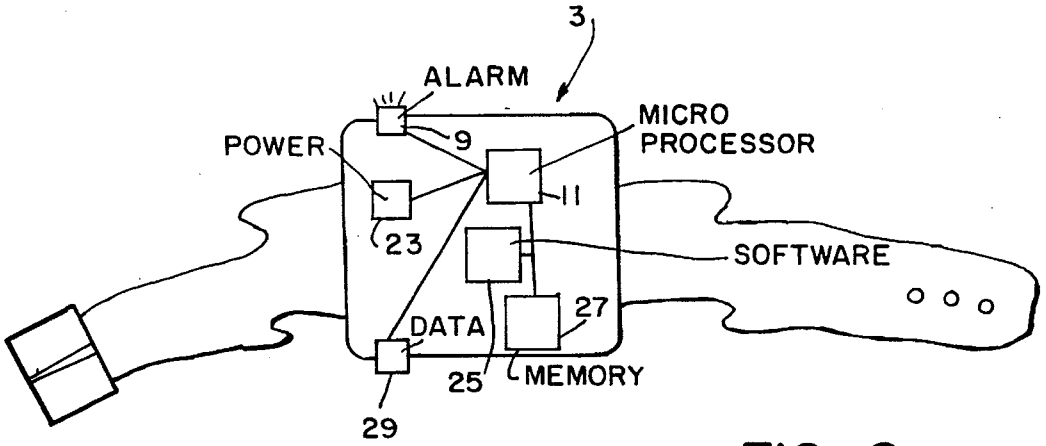
FIG. 2 shows an embodiment of the body-carried reminder.

FIG. 2 shows an embodiment of the body-carried reminder 3. This reminder 3 is wrist-worn, and may include a watch. This embodiment has a portable power supply 23, such as a battery, and an audible alarm as an alarm 9. The alarm is triggered by a signal from a microprocessor 11 which is programmed with user medication software 25. A memory 27 is also used to store data. In this embodiment, information regarding user compliance, prescription schedule and physiologic conditions is received and delivered by a radio frequency or infrared database 29.

Figure 3:
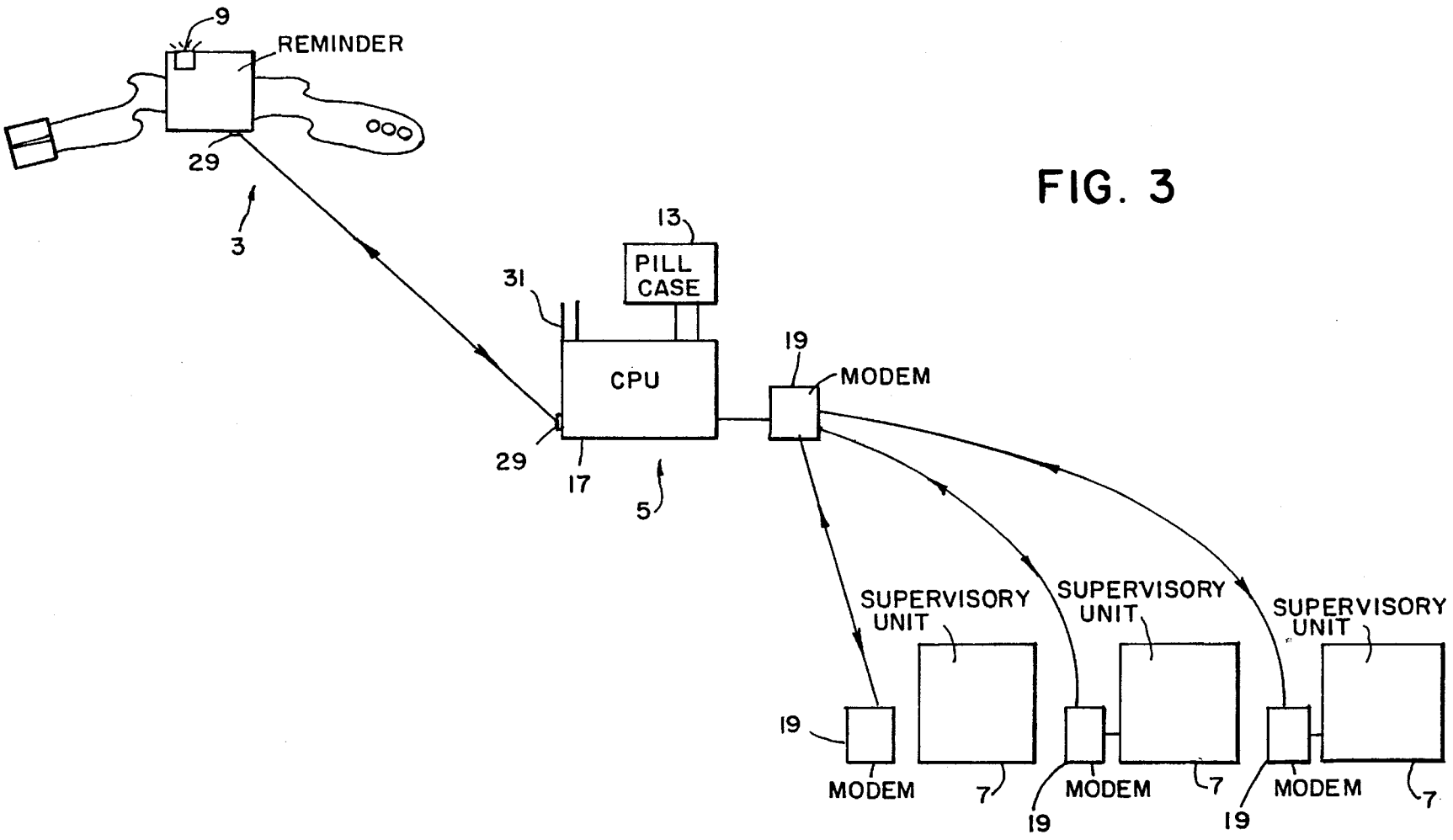
FIG. 3 is an illustration of the configuration of the present invention with particular embodiments.

FIG. 3 shows how the present invention communicates with physicians, pharmacists and care-givers who are located in places remote from the user or the compliance processor 5. Once the alarm 9 on the body-carried reminder 3 is initiated, the central processing unit 17 of the compliance processor 5 awaits an indication of user compliance. If medication is not removed from the pill case 13, the central processing unit 17 sends noncompliance information, via a modem 19, to supervisory units 7 at prearranged locations. These locations can include the offices of pharmacists, care-givers and physicians. In that manner, a record of noncompliance can be kept, and a care-giver or health care professional can closely monitor the user and prevent adverse medical responses due to prescription noncompliance. In addition, the compliance processor 5 in this embodiment has a recharger 31 that can be used to restore the charge back into a drained battery in the reminder 3.

Firms and individuals which would be interested in the described prescription compliance system are physicians, pharmacists and caregivers. Pharmacists can use the system to update medication schedules and monitor compliance when a customer fills a prescription. Physicians can use the system to monitor compliance and alter medication schedules as needed between prescription refills. Caregivers can use the system as a reminder device for complex prescription regimes.

The most effective use of the system occurs when both the physician treating a patient wearing the wrist unit or pendant and the pharmacist who fills the prescriptions for that physician and patient have computer stations which support the described prescription compliance system.

Information of compliance or non compliance may be sent to supervisory units remotely positioned in pharmacies, care-giver facilities and physicians' offices. The present invention provides for close monitoring of patients, and ease in programming detailed prescription regimes. It offers the user the flexibility to travel freely without fear of missing a medication alert.

While the invention has been described with reference to specific embodiments, modifications and variations of the invention may be constructed without departing from the scope of the invention, which is defined in the following claims.

We claim:

1. A medication supervisory reminder apparatus comprising a body-carried reminder having a microprocessor array, an alarm connected to the array, software and memory connected to the array, a portable communications transmitter and receiver connected to the array, and a control key connected to the alarm, a local interactive compliance processor having a fixed communications transmitter communicating with the portable transmitter and receiver on the body-carried reminder, the local interactive compliance processor having a central processing unit, a memory and a timer connected to the processor, and a pill case connected to the processor for communicating an alarm to the body-carried reminder when the pill case is not opened on schedule, further comprising a remote supervisory unit and modems connected to the local interactive compliance processor and to the supervisory unit for communicating non compliance to the supervisory unit by modems.

2. The apparatus of claim 1, further comprising a communications link on the supervisory unit for communicating with the portable receiver on the body-carried reminder for transferring medication regimes from the supervisory unit to the body-carried reminder.

3. The apparatus of claim 2, wherein the local compliance processor has a receiver-transmitter for receiving and transmitting communications of a medication regime from and to the body-carried reminder and for receiving alarm delay requests from the body-carried reminder.

4. A medication supervisory reminder apparatus comprising a body carried remainder having a receiver and transmitter for communicating with a local interactive compliance processor, having a central processing unit, a modem and a pill case connected to the processor for communicating an alarm to the body carried remainder when the pill case is not opened on schedule, a remote supervisory unit having a modem connectable to the local interactive compliance processor modem, for receiving non-compliance messages from the local interactive compliance processor.

5. The apparatus of claim 4, a microprocessor array, an alarm, software, memory, and an input key connected to the array for requesting an alarm delay from the compliance processor.

6. The apparatus of claim 5, wherein the alarm further comprises an auditory alarm, a tactile alarm or a visual display.

7. The apparatus of claim 5, wherein the body-carried reminder is wrist-worn.

8. The apparatus of claim 5, wherein the body-carried reminder is pendant-worn.

9. The apparatus of claim 5, wherein the body-carried reminder and the local interactive compliance processor communicate by radio frequency.

10. The apparatus of claim 5, wherein the body-carried reminder and the local interactive compliance processor are connected by infrared linkage.

11. The apparatus of claim 5, wherein the microprocessor array of the body-carried reminder is programmed with a database containing the medical history of a patient, a patient's prescription regimen and a patient's response to a reminder.

12. The apparatus of claim 5, wherein the local interactive compliance processor further comprises a recharger connectable to the body-carried reminder.

13. A method of communicating medication compliance information comprising programming a body-carried reminder with prescription regime information, initiating an alarm in the body-carried reminder by generating a first signal when actual time corresponds to programmed medication delivery time, alarming a user of the portable reminder through a visual display and the alarm, which are triggered by the first signal, maintaining and transmitting user prescription regimen information, user compliance information and user physiologic information from the body-carried reminder to a central processing unit in a local interactive compliance processor, and storing the data in the central processing unit of the local interactive compliance processor, connecting a remote supervisory unit thru modems to the local interactive compliance processor and communicating non compliance to the supervisory unit.

14. The method of claim 13, further comprising reprogramming the body-carried reminder by a response signal generated by a remote pill case.

15. The method of claim 13, further comprising signalling a medication alarm from the compliance processor to the body-carried reminder.

16. The method of claim 14, further comprising responding to the alarm, the alarm and the visual display is by pressing a delay input key positioned on the body-carried reminder.

17. The method of claim 14, further comprising responding to the alarm, the alarm and the visual display is by opening a pill case connected to the compliance processor and removing medication.

18. The method of claim 13, further comprising delivering a noncompliance message from the central processing unit to a remote supervisory unit.

* * * * *